US006691612B1

(12) United States Patent
Herrmann et al.

(10) Patent No.: US 6,691,612 B1
(45) Date of Patent: Feb. 17, 2004

(54) DRIVING DEVICE FOR PRINTING MACHINES

(75) Inventors: Bernd Herrmann, Malsch (DE); Kurt Lötsch, Wiesenbach (DE); Andreas Schorpp, Au am Rhein (DE); Hendrik Stemmler, Speyer (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 53 days.

(21) Appl. No.: 09/677,323

(22) Filed: Sep. 29, 2000

(30) Foreign Application Priority Data

Sep. 29, 1999 (DE) ..... 199 46 620

(51) Int. Cl.[7] ..... B31F 31/14

(52) U.S. Cl. ..... 101/352.01; 101/216; 101/350.3; 101/351.3; 101/352.04

(58) Field of Search ..... 101/216, 247, 101/218, 350.3, 351.1, 351.3, 352.01, 352.04, 352.06, 352.09

(56) References Cited

U.S. PATENT DOCUMENTS

| | | | | | |
|---|---|---|---|---|---|
| 3,911,815 | A | * | 10/1975 | Banfer | 101/148 |
| 4,244,292 | A | * | 1/1981 | Williams et al. | 101/350.3 |
| 4,458,592 | A | * | 7/1984 | Junghans | 101/350.3 |
| 4,513,663 | A | * | 4/1985 | Hummel et al. | 101/350.3 |
| 4,546,701 | A | * | 10/1985 | Junghans | 101/350.3 |
| 4,672,894 | A | * | 6/1987 | Hardin | 101/348 |
| 4,756,249 | A | * | 7/1988 | Hardin | 101/348 |
| 4,833,987 | A | * | 5/1989 | Hardin | 101/348 |
| 5,027,704 | A | * | 7/1991 | Holl et al. | 101/148 |
| 5,060,568 | A | * | 10/1991 | Jentzsch et al. | 101/148 |
| 5,103,726 | A | * | 4/1992 | Wieland | 101/350.3 |
| 5,619,922 | A | * | 4/1997 | Kelm | 101/148 |
| 6,418,846 | B1 | * | 7/2002 | Hoier | 101/216 |

FOREIGN PATENT DOCUMENTS

| | | |
|---|---|---|
| DE | 185 198 | 12/1905 |
| DE | 30 28 406 A1 | 3/1982 |
| DE | 35 02 863 A1 | 7/1986 |
| DE | 40 13 416 C1 | 11/1991 |
| DE | 197 36 118 A1 | 3/1999 |
| DE | 197 56 077 A1 | 6/1999 |
| DE | 198 40 806 C1 | 11/1999 |

* cited by examiner

*Primary Examiner*—Ren Yan
*Assistant Examiner*—Kevin D. Williams
(74) *Attorney, Agent, or Firm*—Laurence A. Greenberg; Werner H. Stemer; Ralph E. Locher

(57) ABSTRACT

A driving device for printing machines, having a rod for oscillatingly moving a distributor roller in axial direction, includes a joint via which the rod is connected to the distributor roller, the joint permitting relative movement between the rod and the distributor roller so as to compensate for a displacement of the distributor roller perpendicularly to the axial direction of the distributor roller; and a printing machine having the driving device.

10 Claims, 2 Drawing Sheets

DRIVING DEVICE FOR PRINTING MACHINES

BACKGROUND OF THE INVENTION

1. Field of the Invention

The invention relates to a driving device for printing machines, having a rod for moving a distributor roller reciprocatingly in axial direction.

German Patent 18 51 98 describes such a device, wherein an inking roller is seated rotatably on a shaft firmly mounted in the frame. A connecting rod extending into the interior of the inking roller transmits the movement of a journal to the inking roller.

SUMMARY OF THE INVENTION

It is an object of the invention to provide a driving device for printing machines which is considerably improved over corresponding devices heretofore known in the art.

With the foregoing and other objects in view, there is provided, in accordance with one aspect of the invention, a driving device for printing machines, having a rod for oscillatingly moving a distributor roller in axial direction, comprising a joint via which the rod is connected to the distributor roller, the joint permitting relative movement between the rod and the distributor roller so as to compensate for a displacement of the distributor roller perpendicularly to the axial direction of the distributor roller.

In accordance with another feature of the invention, the joint has at least two degrees of freedom.

In accordance with a further feature of the invention, the joint is a self-aligning bearing.

In accordance with an added feature of the invention, the joint is disposed in the distributor roller.

In accordance with an additional feature of the invention, the joint is disposed approximately at the center of mass of the distributor roller.

In accordance with yet another feature of the invention, the rod is couplable via a readily releasable connection to a transmission element for reciprocatingly moving the distributor roller in axial direction.

In accordance with yet a further feature of the invention the connection is a plug-in connection.

In accordance with an alternative feature of the invention, the connection is a snap-in connection.

In accordance with yet an added feature of the invention, the connection is located outside the distributor roller.

In accordance with a concomitant aspect of the invention, there is provided a printing machine having a driving device provided with at least one of the foregoing features.

The driving device according to the invention is distinguished by the fact that the rod and the distributor roller are connected to one another via a joint which permits relative movement between the rod and the distributor roller if the distributor roll is displaced perpendicularly to the axial direction thereof.

The advantageous feature of the driving device according to the invention is that the distributor roller is entrainable together with two applicator rollers towards and away from a plate cylinder, without losing the rolling contact between the distributor roller and the two applicator rollers during the displacement.

In one embodiment of the invention, which is advantageous with regard to the ability of the middle axis of the distributor roller to be pivoted, the joint is rotatable about at least two ideal axes of rotation, one of which extends coaxially with the middle axis of the distributor roller, and the other extends transversely to the middle axis of the distributor roller.

In an embodiment which is advantageous with regard to any desired skewed positions of the distributor roller relative to the rod, the joint has three degrees of freedom or ideal axes of rotation. Such a joint is, for example, a self-aligning or pivot bearing, which permits pivoting movements of the distributor roller in all planes wherein the middle axis is located.

In an embodiment which is advantageous with regard to a space-saving compact construction of the driving device, the joint is disposed in the interior of the distributor roller.

In an embodiment which is advantageous with regard to the constancy of the widths of the press strips formed by the distributor roller together with the applicator rollers over the roller lengths, the joint, as viewed in the axial direction of the distributor roller, is disposed approximately in the middle thereof.

In an embodiment which is advantageous with regard to the simple removal of the distributor roller from the printing machine for roller maintenance, at the end of the rod opposite or distal from the joint, the rod is connected by a readily releasable connection to a transmission element which reciprocatingly moves the rod and, via the latter, the distributor roller. The reciprocatory movement of the rod is transmitted to the distributor roller by the joint, which in this case functions not only as a radial bearing but also as an axial bearing. Before removing the distributor roller, the pressman can release the connection, if desired, and make the connection once again after the reinsertion of the distributor roller.

In an embodiment which is advantageous with regard to a positive or form-locking coupling of the transmission element to the rod, the connection is a plug-in connection. In this regard, it is noted that a form-locking connection is one which connects two elements together due to the shape of the elements themselves, as opposed to a force-locking connection, which locks the elements together by force external to the elements.

In an embodiment which is advantageous with regard to making and releasing the connection without any tools, the connection is not only a plug-in connection but also a snap-in connection.

In an embodiment which is advantageous with regard to good accessibility of the connection when it is being made and released, that end of the rod at which the connection is located projects out of the interior of the distributor roller.

The driving device is preferably a constituent part of an inking unit of a rotary offset printing machine.

Other features which are considered as characteristic for the invention are set forth in the appended claims.

Although the invention is illustrated and described herein as embodied in a driving device for printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
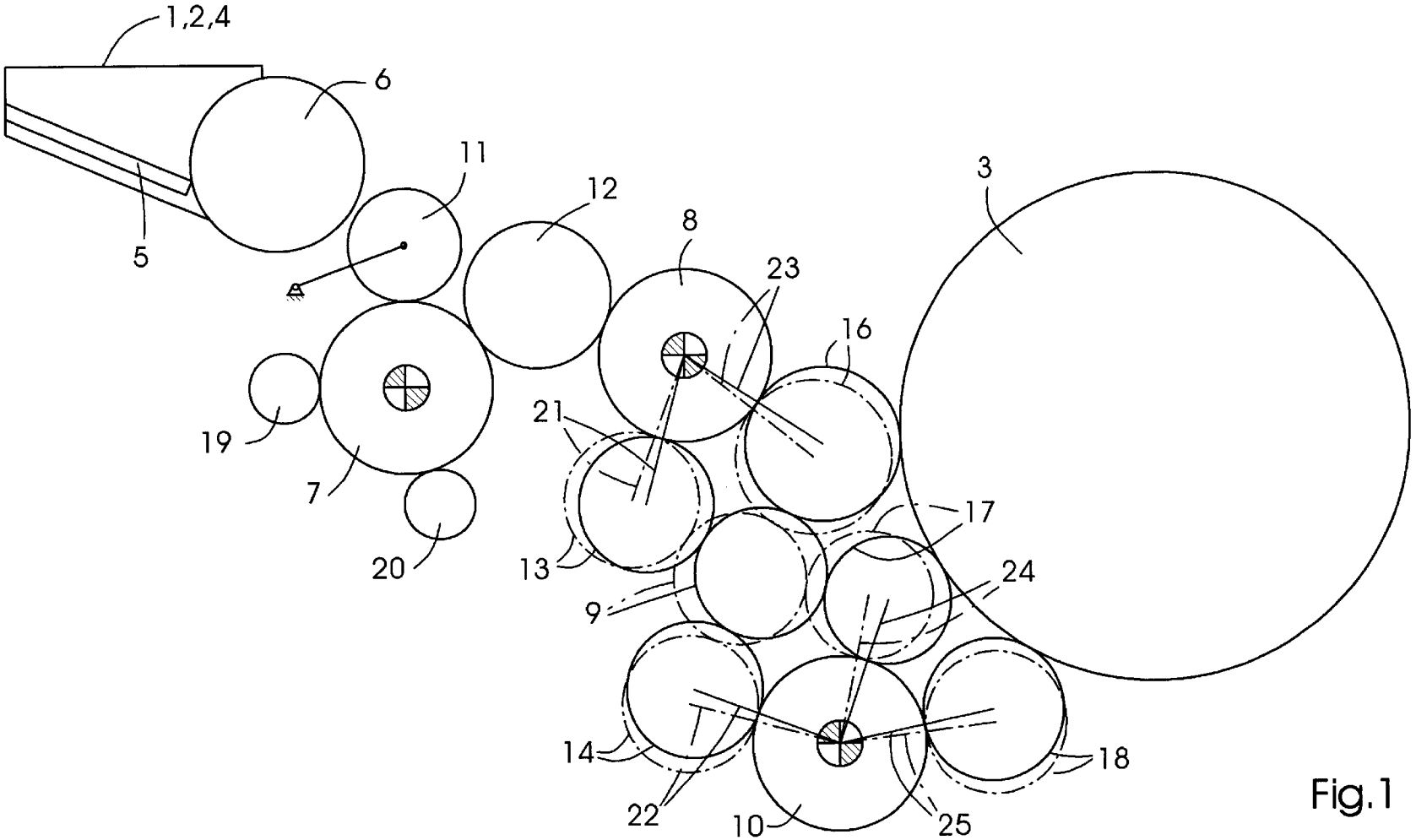
FIG. 1 is a diagrammatic side elevational view of a printing machine having an inking unit and a distributor roller.

Referring now to the drawings and, first, particularly to FIG. 1 thereof, there is illustrated therein a printing machine 1, which is constructed as a rotary offset printing machine and is represented by an enlarged detail of the inking unit 2 thereof for inking a printing-plate cylinder 3. The printing-plate cylinder 3 has an otherwise non-illustrated blanket cylinder assigned thereto, which transfers the ink applied thereto to sheet printing material which, in this case, rests on an otherwise non-illustrated impression cylinder.

The inking unit 2 includes an ink fountain or duct 4 for storing the ink and a metering device 5 assigned to the latter for a zonally varying adjustment of the ink layer thickness on an ink duct roller 6, which conveys the ink out of the ink duct 4. In addition, the inking unit 2 includes a number of distributor rollers 7 to 10, and a vibrator roller 11, which oscillates between the rollers 6 and 7, alternately making rolling contact with the latter rollers, and transfers the ink from the ink duct roller 6 to the distributor roller 7. The inking unit 2 further includes a number of transfer rollers 12 to 14, respectively, arranged in a roller train between two of the distributor rollers 7 to 10, and a number of applicator rollers 16 to 18, which roll on the printing-plate cylinder 3 during ink application, the applicator roller 16 being in rolling contact with the distributor rollers 8 and 9, the applicator roller 17 being in rolling contact with the distributor rollers 9 and 10, and the applicator roller 18 being in rolling contact with the distributor roller 10. The inking unit 2 also includes two inking rollers 19 and 20 for smoothing or evening-out the ink, each of the inking rollers 19 and 20 engaging only with the distributor roller 7.

The inking unit 2 is shown in two different switching states, namely in an impression-on position, illustrated in solid lines in FIG. 1, wherein the applicator rollers 16 to 18 engage with the printing-plate cylinder 3, and an impression-off position, illustrated in broken lines, wherein the applicator rollers 16 to 18 are lifted off the printing-plate cylinder 3. When the applicator rollers 16 to 18 are displaced towards or away from the printing-plate cylinder 3, the rollers 9, 10, 13 and 14 are simultaneously displaced into the impression-on positions thereof shown in solid lines, or the impression-off positions thereof shown in broken lines. So that, during these displacements, the rolling contact between the rollers 13 and 16 and the distributor roller 8, and the rolling contact between the rollers 14, 17 and 18 and the distributor roller 10 are maintained, each of the rollers 13 and 16 can be pivoted coaxially with respect to the distributor roller 8 and in the same direction as the respective other roller 13 or 16 through the intermediary of respective bearings 21 and 23, and each of the rollers 14, 17 and 18 can be pivoted coaxially with respect to the distributor roller 10, respectively, through the intermediary of respective bearings 22, 24 and 25, it being possible for the rollers 14 and 17 to be pivoted in the same direction as one another, and for the applicator rollers 17 and 18 to be pivoted in opposite directions. Each of the bearings 21 to 25 may, in the simplest case, be a lever, which can be pivoted about a pivoting joint arranged coaxially with respect to the respective distributor rollers 8 and 10, and wherein the respective rollers 13, 14, 16, 17 are 18 mounted so as to be rotatable.

The distributor roll 9 rests simultaneously and permanently on the rollers 14 and 17 and is additionally held further by the rollers 13 and 16 which permanently rest on or engage the distributor roller 9, so that the distributor roller 9 is secured in position on all sides in the radial direction by the adjacent rolls 13, 14, 16, 17. The distributor roller 9 has no rotary drive positively or form-lockingly coupled thereto, and is rotatively driven instead by frictional entrainment with the rollers 13, 14, 16 and 17, the rollers 13 and 16, in turn, being driven by frictional entrainment with the distributor roller 8, and the rollers 14 and 17 being rotatively driven by frictional entrainment with the distributor roller 10, and the distributor rollers 8 and 10 being rotatively driven positively or form-lockingly by an otherwise non-illustrated electromotive drive, as is also the distributor roller 7.

Figure 2:
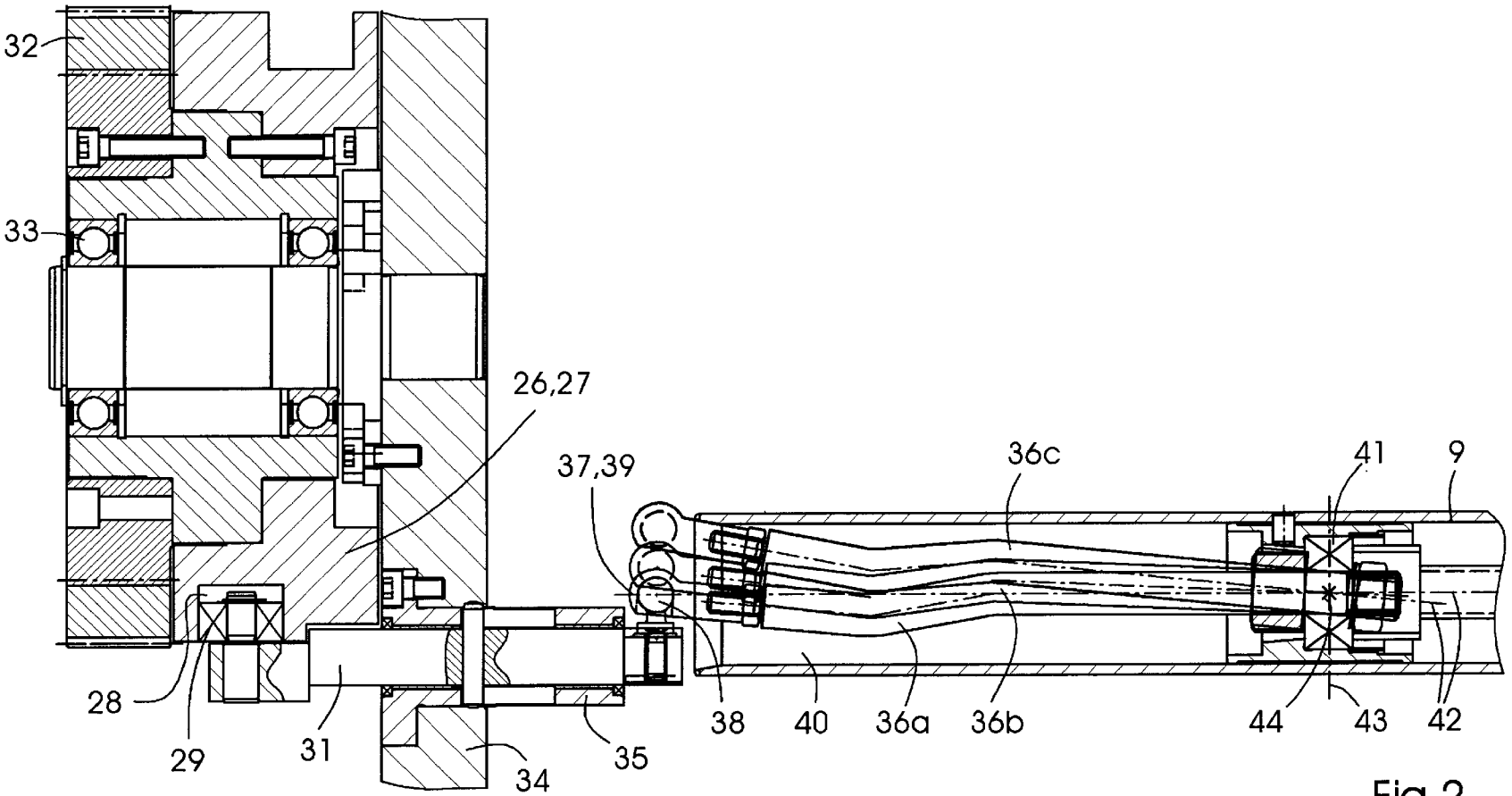
FIG. 2 is a detailed longitudinal sectional view of the distributor roller and a driving device of the inking unit, in accordance with the invention.

FIG. 2 shows that the axial oscillation of the distributor roller 9 is driven by a driving device, which includes the otherwise non-illustrated electromotive drive that rotatively drives the distributor rollers 7, 8 and 10, and also, rotatively drives the printing-plate cylinder 3, as a main drive of the printing machine 1.

The driving device also includes a three-dimensional cam transmission 26 having a cam element 27 constructed as a grooved cam cylinder. Guided in a closed circumferential groove 28 around the cam element 27 is a rolling-contact cam roller 29, which is rotatably mounted in a transmission element 31. Arranged coaxially with respect to the cam element 27 and connected so as to rotate with the latter is a drive gear 32 formed as a spur gear or pinion which, in the same manner as for the cam element 27, is rotatably fixed, via a rotating bearing 33 formed as a rolling-contact bearing, on a frame 34 that forms one side wall of the printing machine 1. The cam element 27 and the drive gear 32 are seated spaced from one another on a respective extension of an otherwise non-illustrated bushing, to which they are threadedly secured. The bushing is rotatably seated, via the rotating bearing 33, on an otherwise non-illustrated pin that is stuck or plugged into the frame 34 and threadedly secured thereto.

The aforementioned electromotive drive drives the cam element 27 via a gear transmission, to which the drive gear 32 also belongs. The transmission element 31 is formed as a slider which is reciprocatingly movable parallel to the axis of rotation of the cam element 27 and also to the axis of rotation of the distributor roller 9 by the rotating cam element 27, and is linearly guided in the aforementioned direction by a thrust joint 35 fixed to the frame 34.

At that end of the transmission element 31 which is located distal to the cam roller 29, the transmission element 31 is connected, via an easily releasable connection 37, to a double-cranked rod 36 shown in FIG. 2 in three positions as 36*a*, 36*b* and 36*c*. The connection 37 is formed as a universal or sliding joint, made up of a ball 38 fixed to the transmission element 31, and a pan or pot 39 fixed to the rod 36, and having at least two and preferably at least three degrees of freedom, each degree of freedom corresponding to a direction of rotation of the universal or sliding joint. The rod 36 extends through a hollow space 40 formed in the tubular distributor roller 9 up to a joint 41 which is arranged in the hollow space 40 and which, at that end of the rod 36 which is distal or opposite from the connection 37, is arranged to connect the rod 36 to the distributor roller 9.

The joint 41 has an axis of rotation 42 about which the distributor roller 9 rotates, a vertical axis 43 and a horizontal axis 44, as well as virtually an infinite number of further axes which lie in the plane wherein the axes 43 and 44 are disposed and which intersect the axes 42 to 44 at a single pole point of the joint 41 which is formed as a self-aligning or pivot bearing. The joint 413 is preferably formed as a self-adjusting bearing and, for example, as a self-aligning roller bearing or a self-aligning ball bearing. If the distributor roller 9 is in the impression-off position thereof, illustrated in phantom in FIG. 1, the rod 36 assumes the position 36*b* thereof. When the distributor roller 9 is displaced out of the impression-off position thereof into the impression-on position thereof, illustrated by solid lines, the relative position between the rod 36 and the distributor roller 9 is changed, the rod 36 changing from the position 36*b* thereof into the position 36*a* thereof. When the distributor roller 9 is in the impression-on position thereof, the rotational axis 42 of the joint 41 is aligned precisely with the middle axis of the distributor roller 9, and the pole point of the connection 37 lies on an ideal extension line of the middle axis of the distributor roller 9. When the joint 41 is displaced from the impression-off position into the impression-on position, the joint 41 is rotated about an axis extending perpendicularly to the rotational axis 42 and which, depending upon the direction of the displacement of the distributor roller 9, can be the vertical axis 43, the horizontal axis 44 or an axis lying in the plane wherein these axes 43 and 44 are disposed.

Whereas the joint 41 permits the rod 36 to be displaceable relative to the distributor roller 9 into any desired skewed positions and also into the coaxial position, the connection 37 permits the rod 36 to be displaceable into any desired skewed positions in relation to the transmission element 31, the compensatory movement executed by the connection 37 when the distributor roller 9 is displaced, occurring in a direction opposite to the compensatory movement executed by the joint 41. When the distributor roller 9 is displaced back from the impression-on position thereof into the impression-off position thereof, relative movements which are opposed to the aforementioned relative movements take place, the rod 36 changing the position thereof relative to the distributor roller 9 by moving from the position 36*a* thereof into the position 36*b* thereof.

The operator is able to release the connection 37 by pulling the pan or pot 39 off the ball 38 counter to the spring action thereof, so that the rod 36 can be displaced into a position 36*c* which permits the distributor roller 9 to be removed and installed. The radial spring action of the pan or pot 39 is provided by having it constructed of an elastic material. The pan or pot 39 may also be provided with slits, which spread out when the pan or pot 39 is stuck or plugged onto the ball 38, so that the opening of the pan or pot 39 is briefly expanded until the pan or pot 39 enclosingly catches or locks the ball 38 in positively or form-lockingly.

It is also conceivable, in an arrangement opposed to the arrangement shown in the drawings, for the ball 38 to be assigned to the rod 36, and for the pan or pot 39 to be assigned to the transmission element 31.

The joint 41 advantageously permits the rotating distributor roller 9 to be driven in the axial direction thereof by the cam transmission 26 both in the impression-on position thereof and in the impression-off position thereof.

In this regard, the groove 28 formed in the rotating cam element 27, because of the construction thereof so as to run obliquely around the latter, displaces the transmission element 31 alternately to the left-hand side and to the right-hand side, with regard to FIG. 2, this movement being transmitted to the distributor roller 9 via the connection 37, the rod 36 and the joint 31. In this case, the joint 41 acts not only as a radial bearing permitting the rotation of the distributor roller 9, but also as an axial bearing which accommodates the push-and-pull movement of the rod 36.

We claim:

1. A driving device for printing machines, comprising:

a distributor roller rotatively driven solely by frictional roller-entrainment;

a reciprocating push-and-pull-rod for oscillatingly moving said distributor roller in an axial direction of said distributor roller; and a joint for connecting said reciprocating push-and-pull-rod to said distributor roller, said joint permitting relative movement between said reciprocating push-and-pull-rod and said distributor roller for compensating for a displacement of said distributor roller perpendicularly to said axial direction of said distributor roller, said joint being disposed in said distributor roller.

2. The driving device according to claim 1, wherein said joint has at least two degrees of freedom.

3. The driving device according to claim 1, wherein said joint is a self-aligning bearing.

4. The driving device according to claim 1, wherein said joint is disposed approximately at the center of mass of said distributor roller.

5. The driving device according to claim 1, wherein said reciprocating push-and-pull-rod is couplable via a readily releasable connection to a transmission element for reciprocatingly moving said distributor roller in said axial direction.

6. The driving device according to claim 5, wherein said connection is a plug-in connection.

7. The driving device according to claim 5, wherein said connection is a snap-in connection.

8. The driving device according to claim 5, wherein said connection is located outside the said distributor roller.

9. A printing machine having a driving device constructed in accordance with claim 1.

10. A driving device for printing machines, comprising:

a distributor roller rotatively driven solely by frictional roller-entrainment;

a reciprocating push-and-pull-rod for oscillatingly moving said distributor roller in an axial direction of said distributor roller;

a joint for connecting said reciprocating push-and-pull-rod to said distributor roller, said joint permitting relative movement between said reciprocating push-and-pull-rod and said distributor roller for compensating for a displacement of said distributor roller perpendicularly to said axial direction of said distributor roller said, joint being disposed in said distributor roller; and a readily releasable connection located outside said distributor roller, said reciprocating push-and-pull-rod being couplable via said readily releasable connection to a transmission element for reciprocatingly moving said distributor roller in said axial direction.

* * * * *